United States Patent [19]

Miller

[11] Patent Number: 4,769,936

[45] Date of Patent: Sep. 13, 1988

[54] FIREARM SAFETY

[76] Inventor: Nicholas A. Miller, 7182 County Rd. 11A, Auburn, Ind. 46706

[21] Appl. No.: 944,223

[22] Filed: Dec. 22, 1986

[51] Int. Cl.[4] ..... F41C 17/08

[52] U.S. Cl. ..... 42/66; 42/70.08

[58] Field of Search ..... 42/64, 66, 70.08, 70.04, 42/70.05, 70.06, 59, 62

[56] References Cited

U.S. PATENT DOCUMENTS

| | | | |
|---|---|---|---|
| 635,705 | 10/1899 | Wesson et al. | 42/62 |
| 3,422,559 | 1/1969 | Woloch | 42/66 |
| 3,978,603 | 9/1976 | Murabito | 42/66 |
| 3,988,847 | 11/1976 | Kennedy | 42/62 |
| 4,091,557 | 5/1978 | Murabito | 42/66 |

*Primary Examiner*—Deborah L. Kyle
*Assistant Examiner*—Michael J. Carone
*Attorney, Agent, or Firm*—Roger M. Rickert

[57] ABSTRACT

A safety device for a revolver is disclosed which automatically interposes a hammer blocking member immediately adjacent the hammer to prevent the hammer being retracted or cocked each time the cylinder of the revolver is opened as for example, when loading the cylinder. Further deliberate action by the user independent of either the loading process or the firing process is required to unblock the hammer and ready the gun for firing.

5 Claims, 3 Drawing Sheets

FIREARM SAFETY

SUMMARY OF THE INVENTION

The present invention relates generally to safety devices for firearms and more particularly to such safety devices for use on revolvers which typically lack such safety features. More specifically, the safety device of the present invention is automatically actuated to an "on" or safe condition each time the cylinder of the revolver is opened and then closed as, for example, when loading the gun, and must be manually moved to a ready to fire position by the user before the gun can be discharged.

The desirability of safety mechanisms on firearms has long been recognized and their presence on semi-automatic or self-loading weapons as well as on other weapons which manually load and simultaneously cock a hammer, such as pump action shot guns, is standard. Typically, these safety devices are simple toggle mechanisms movable between "safe" and "ready" positions and either prevent the trigger from being pulled or prevent an already cocked hammer from moving to strike and discharge a cartridge when in the "safe" position. A variation on this typical arrangement is illustrated in an early U.S. Pat. No. 206,217 where a lever operated breech-block rifle had the firing pin retracted or cocked each time a round was chambered and at the same time positioned a trigger blocking safety to prevent the trigger from being pulled until the safety was manually moved to the ready to fire position.

Several attempts to equip conventional single or double action revolvers with safety arrangements have been suggested, but none have met with widespread commercial acceptance primarily because none has recognized the function that a revolver safety should serve. For example, U.S. Pat. No. 3,978,603 describes a safety wherein the thumbpiece or cylinder release button may be manually moved to a position intermediate its closed and open positions and then twisted somewhat to latch the button in that intermediate position preventing actuation of the firing mechanism. As another example, U.S. Pat. No. 4,091,557 shows a three position cylinder release button which, when in its intermediate position, prevents a pawl element within the gun from being moved in response to activation thereof by the trigger mechanism to fire the gun.

Each of the above-mentioned safety arrangements is deficient in one or more of the following aspects. The safety arrangement can be actuated or "put on" only when the firing pin or hammer is retracted or cocked and ready to be released for striking and discharging a cartridge. In these cases, the safety may be applied only when the firearm is in its most dangerous configuration. The safety arrangement functions to block the trigger, pawl, or other element in the mechanical linkage between the trigger and the firing pin or hammer. In these cases, each additional link, in a sense, weakens the chain and mechanical failure, excess wear, or a sudden jolt may defeat the safety allowing unintentional discharge of the firearm. The safety arrangement must be consciously applied by the user and, if forgotten, is no safety at all.

Among the several objects of the present invention may be noted the provision of a safety device for a firearm which overcomes the above-noted deficiencies; the provision of a safety device which automatically places a firearm in the safest possible configuration each time the firearm is loaded; the provision of a safety mechanism especially adapted to revolvers; the provision of a safety device for a revolver which is actuated or applied each time the cylinder of the revolver is opened and then closed as, for example, during the loading process; the provision of a safety arrangement which may be easily and economically incorporated into firearms of current manufacture either during manufacture or as a retrofit; and the overall reduction in the likelihood of firearm accidents. These as well as other objects and advantageous features of the present invention will be in part apparent and in part pointed out hereinafter.

In general, the safety feature of the present invention is achieved by automatically directly blocking the hammer of a firearm so that the hammer can not be retracted each time the cylinder of the firearm is opened and then closed during a loading process.

Also in general and in one form of the invention, a safety device for a handgun of the revolver type having a thumbpiece movable between cylinder loading and cylinder closed positions has a hammer block which selectively directly engages the hammer to prevent pivotal movement of the hammer away from the cylinder and an arrangement responsive to movement of the thumbpiece for positioning the hammer block in its blocking position until further deliberate action by the user independent of the loading process places the firearm in a ready to discharge condition.

Still further in general and in one form of the invention, a revolver is modified to add an automatically setting manually disengagable safety feature by notching the revolver frame along the path of travel of the cylinder release mechanism intermediate the extremes thereof, and spring biasing a portion of the cylinder release mechanism to engage the frame notch interrupting travel of the cylinder release mechanism when moving along the path of travel in one direction only.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
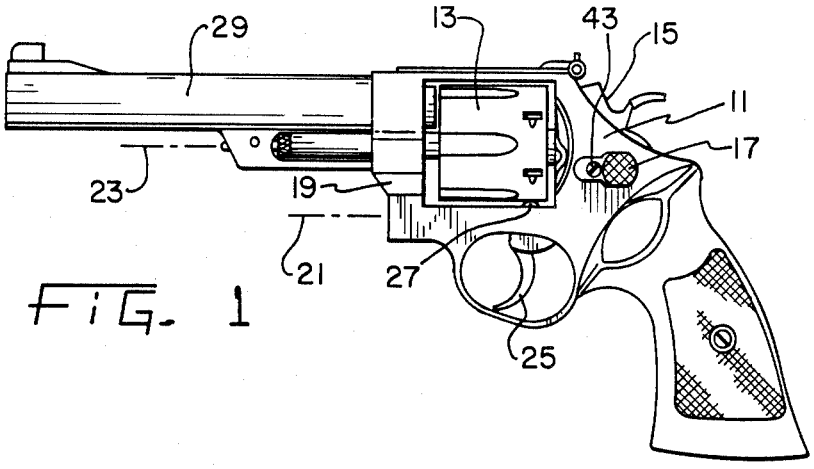
FIG. 1 is a side elevation view of a revolver incorporating one form of the invention.

FIG. 1 illustrates a Smith & Wesson revolver having a frame 11, a cartridge receiving cylinder 13 rotatable about its axis 23, an exposed pivotable cartridge striking hammer 15 spring biased by a leaf or coil spring within the frame toward the cylinder and manually pivotable against the spring bias away from the cylinder (clockwise as viewed) preparatory to discharging a cartridge, and a thumbpiece 17 movable between a first position where the cylinder is unlatched and may be swung out by pivoting the yoke or crane 19 about the axis 21 facilitating insertion of cartridges into the cylinder and a second position (toward the right as viewed) where the cylinder is in the illustrated closed position and cartridges are captive within the cylinder. The revolver is illustrated as a double-action type where the hammer 15 may be cocked by thumb movement and then released by a light pull on the trigger 25 or a much heavier pull on trigger 25 may be used to cock and then release the hammer in one motion. The revolver may include a cylinder stop or key 27 to insure that successive cylinder chambers align properly with the barrel 29, an internal pawl for indexing the cylinder, and other features which are conventional and well documented in the literature.

Nomenclature is not uniform throughout the firearms industry. For example, many modern revolvers include a piece which is interposed between the hammer and a portion of the frame when the hammer is in a down (but slightly rebounded) position to prevent a sharp blow to the exposed hammer spur from being transmitted by the hammer firing pin to a cartridge in the cylinder. Such an arrangement prevents accidental discharge when the revolver is, for example, dropped. In a Colt, this piece is referred to as a "safety" while Smith & Wesson refers to this piece as a "hammer block." As used herein, however, "hammer block" refers to a feature which prevents pivotal motion of the hammer away from a cartridge and to the cocked position. Such hammer blocking in the present invention may be achieved by interposing a member beneath the typical horizontal lower ledge of the hammer rearward of the hammer pivot pin.

Figure 2:
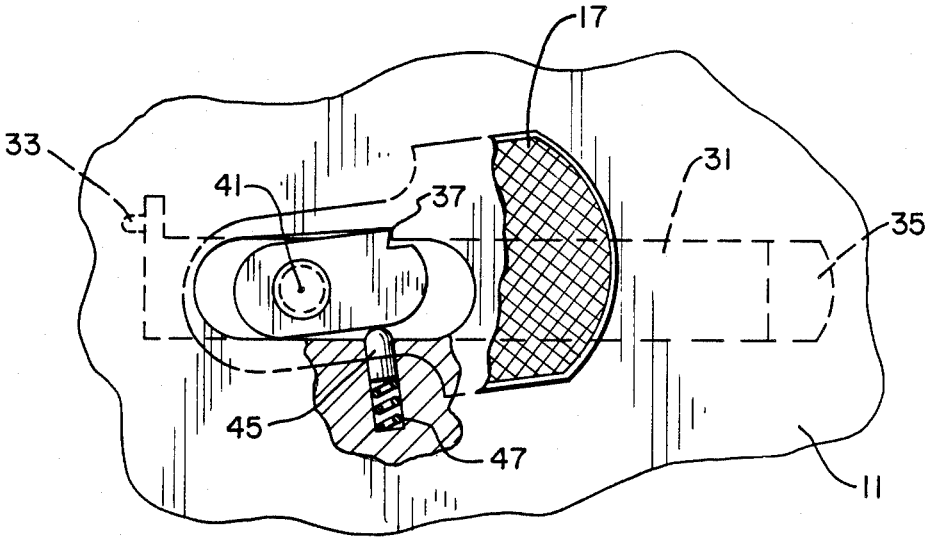
FIG. 2 is a cut away view of a portion of the revolver of FIG. 1 from the outside thereof illustrating the thumbpiece and hammer block in the "safe" position.

Within the frame, as illustrated in FIG. 2, is a locking bolt or latch 31 movable horizontally as viewed in an internal milled slot in the frame 11 under the control of thumbpiece 17. When this thumbpiece is moved toward the left, projection 33 moves along the axis 23 forcing a cylinder latching center pin out of engagement with the frame and allowing the cylinder to be swung out or pivoted about axis 21 for loading. When cylinder 13 is swung back or closed, the spring loaded center pin pushes the locking bolt 31 to the right normally sufficiently far that the projecting or enlarged end 35 of bolt 31 clears the operating path of hammer 15. The present inventive arrangement halts this rightward motion short of the hammer clearing extreme by causing automatic engagement of the frame notch 37 and thumbpiece corner 39. Thus, upon closing the cylinder, the safety is automatically "on" with the hammer blocked from being retracted either directly or by trigger motion by projection 35.

When the user desires to discharge the gun, he must first apply downward pressure to thumbpiece 17 causing it to pivot clockwise in an arcuate path about the axis 41 of cap screw 43 against the pressure of spring 47 loaded plunger 45 to disengage the notches 37 and 39 and allow the locking bolt to move further toward the right and the projection 35 to clear the path of hammer 15. It will be noted that the notches 37 and 39 are inclined slightly (the mating faces are oblique relative to the direction of locking bolt motion) so that the safety mechanism will not release accidentally, for example, if the revolver is dropped. Thus, the abovementioned downward pressure and pivoting of thumbpiece 17 is actually accompanied by a slight leftward motion when the safety is disengaged. The revolver is now ready to fire. The user can reset the safety feature by simple leftward movement of the thumbpiece or button 17 sufficiently far to engage notches 37 and 39. Anytime the cylinder is released and then closed, the safety feature automatically resets to the position shown in FIG. 2.

When modifying an existing safetyless swing-out cylinder type revolver to add the automatically actuated, manually disengagable safety feature, the notch 39 is milled or otherwise cut into the back face of thumbpiece 17 and a mating notch 37 is cut in the revolver frame along the path of travel of the cylinder release mechanism intermediate the extremes thereof. A blind hole is drilled in the frame sidewall generally orthogonal to the direction of thumbpiece travel to receive the spring 47 and plunger 45 for spring biasing the thumbpiece 17 to engage the frame notch interrupting travel of the cylinder release mechanism when moving along the path of travel in one direction only. This blind hole is skewed or slightly inclined relative to the plane of FIG. 2 to allow drilling access as well as insertion and removal of plunger 45 and spring 47 through the existing frame slot which normally receives the inner portion of thumbpiece 17.

Figure 4:
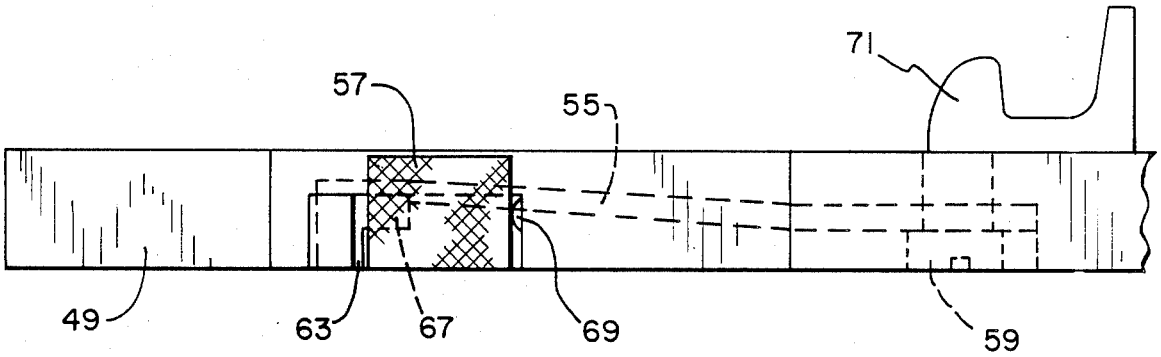
FIG. 4 is a plan view of one side portion of the frame of a revolver incorporating another form of the invention.
Figure 5:
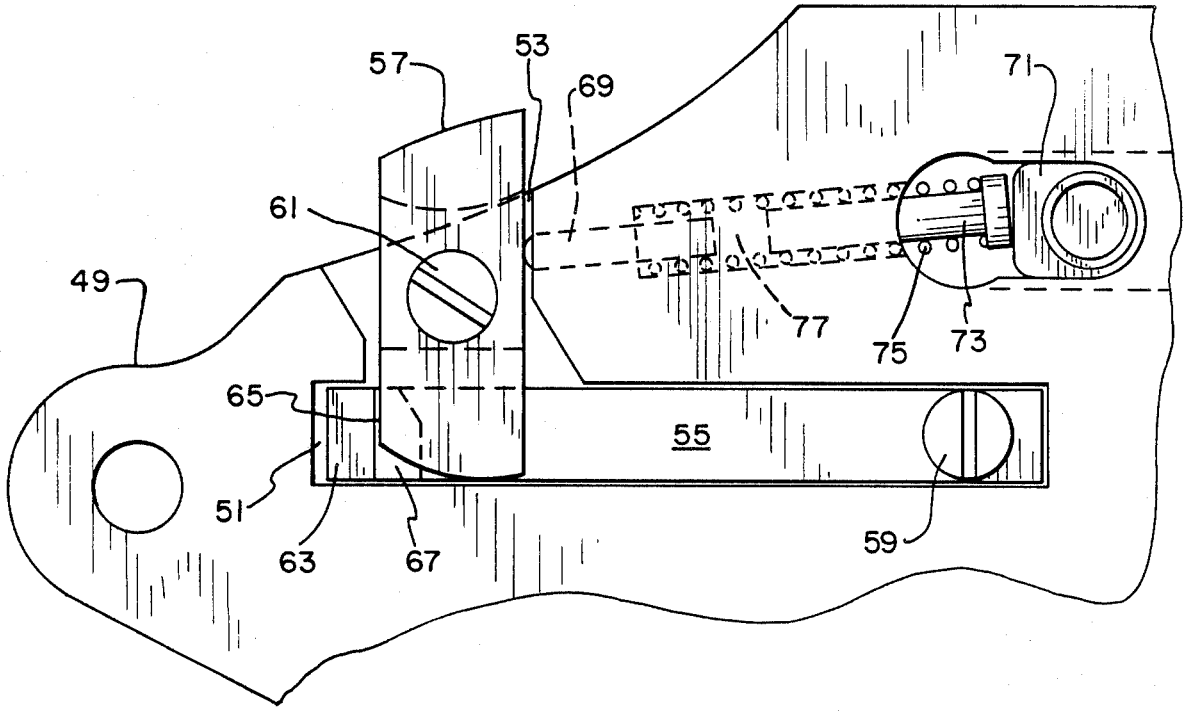
FIG. 5 is a side elevation view of the revolver portion of FIG. 4 from within the gun.
Figure 6:
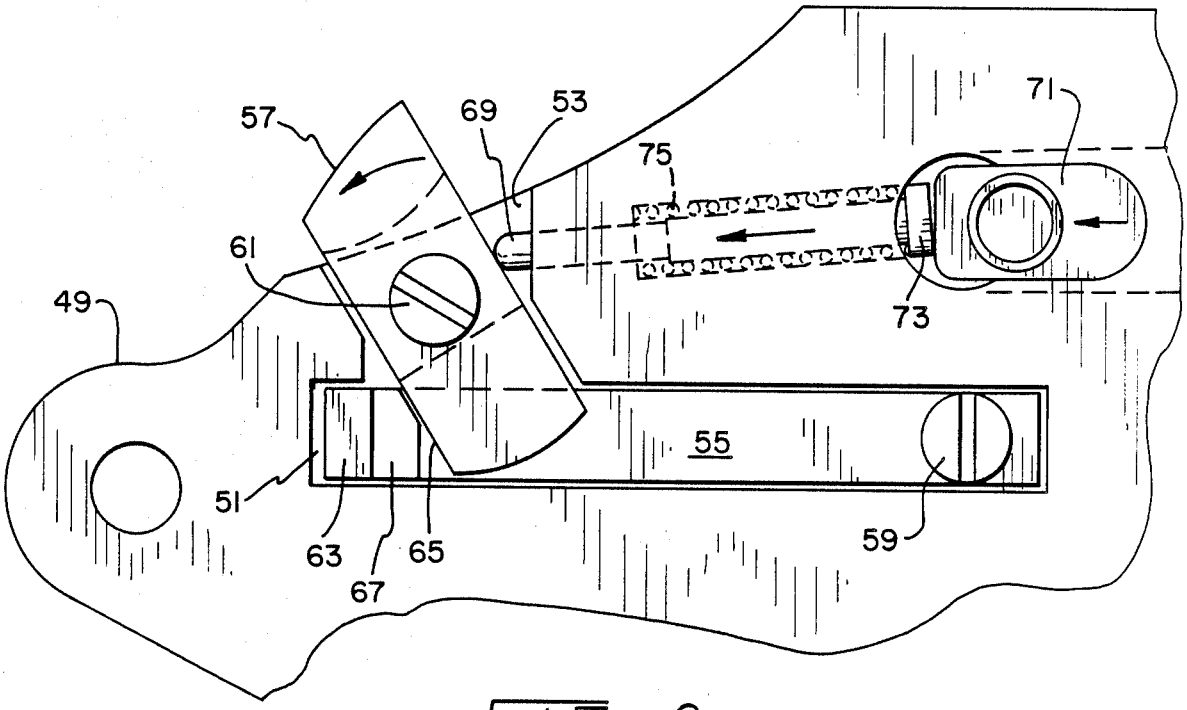
FIG. 6 is a view similar to FIG. 5, but illustrating the safety-on positioning of the parts.
Figure 7:
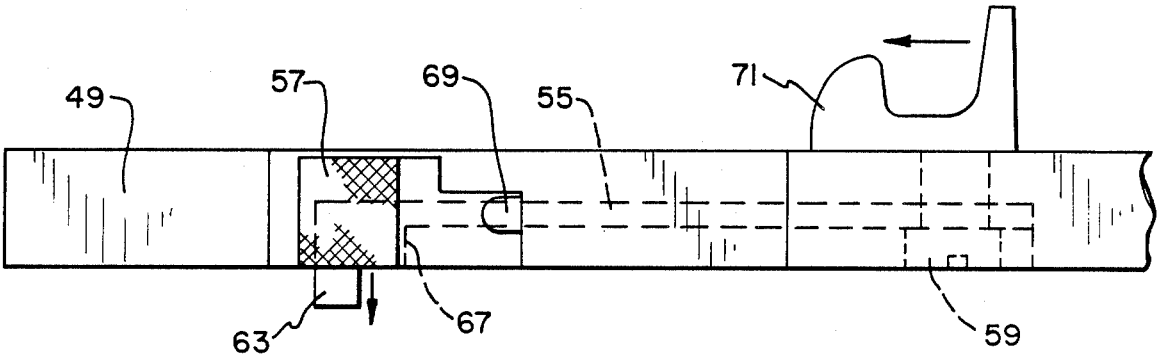
FIG. 7 is a view similar to FIG. 4, but showing the safety-on configuration.

FIGS. 4–7 illustrate a portion of a revolver, such as the well known Colt, modified to incorporate an automatic safety in accordance with the present invention. FIGS. 4 and 5 illustrate the safety off or ready to fire configuration while FIGS. 6 and 7 show the positioning of the parts when the safety is on. The removable side plate 49 has been modified to include slots 51 and 53 milled or otherwise cut in its inner face to receive, in a cantilever mounted manner, leaf spring 55, and partially exposed lever 57 respectively. The side plate 49 is also drilled and tapped to threadingly receive screw 59 for fastening one end of the hammer blocking spring or blade 55, and screw 61 for pivotably affixing lever 57. A third modification to the conventional Colt revolver is to extend the hole 77 rearwardly to communicate with slot 53 and to receive pin 69. With the parts assembled, this pin 69 is held captive within the extended hole between plunger 73 and safety lever 57 and transmits cylinder opening motion into movement of the safety lever. The hammer block comprises end 63 (shown in its hammer blocking or engaging position in FIGS. 6 and 7) of spring member 55 which is self biased toward the hammer engaging position. The pivotable safety lever 57 has a cam surface 65 for engaging the spring at 67 and moving the spring member against the bias thereof out of engagement with the hammer and into the position shown in FIGS. 4 and 5.

Colt revolvers differ from the earlier described Smith & Wesson design in that the thumbpiece 71 is normally biased forward or toward the right as viewed in FIG. 4 and has a pin (not shown) which extends into the cylinder to hold the cylinder in its closed position. Rearward movement of the thumbpiece 71 is required to open the cylinder. This rearward movement moves plunger 73 against the bias of spring 75 and is translated into a rearward force on the pin 69. Pin 69 functions as a means for coupling the thumbpiece 71 to the safety lever 57 for toggling the safety lever in one rotational sense (rearward or counter-clockwise as viewed) out of engagement with the spring member 55 upon movement of the thumbpiece from said second (forward or closed) position to said first (rearward or open) position. One end of the safety lever is exposed with the deliberate independent movement to remove or turn off the safety feature being pivotal motion in a clockwise rotational sense.

Figure 3:
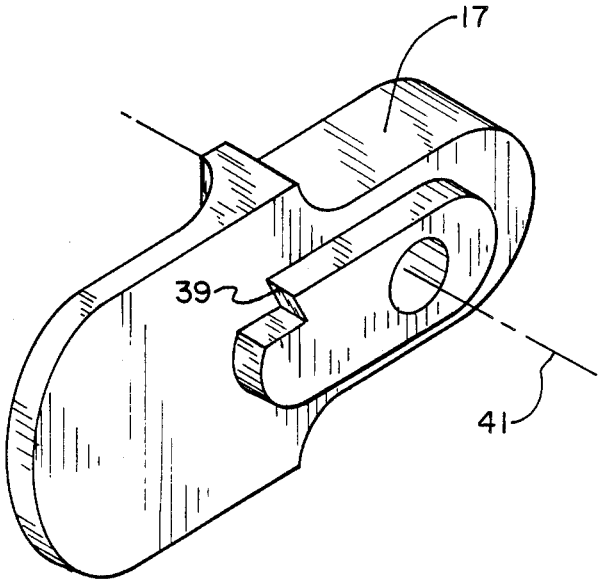
FIG. 3 is a perspective view of the thumbpiece of FIGS. 1 and 2.

With the hammer blocking arrangement of FIGS. 1–3, it is not possible to apply the safety while the hammer is in the cocked position, however, with the arrangement of FIGS. 4–7, the safety may be actuated while the hammer is in the cocked position, but one of the lateral faces of the hammer will maintain spring 55 in the position of FIGS. 4 and 5 until the hammer is released and moved toward the cylinder allowing the hammer block to spring to the position of FIGS. 6 and 7.

Many of the unique features of the present invention are common to both illustrated implementations. The safety device is set or applied automatically in response to motion of a cylinder opening device, but may also be set manually without opening the cylinder if desired. The safety device is quickly and easily shifted to the ready to fire position so as to not interfere with emergency use, for example, by a law enforcement official. Direct blocking of hammer retraction rather than blocking of or interference with intermediate portions of the firing mechanism provides a more positive fail-safe safety arrangement.

From the foregoing, it is now apparent that a novel firearm safety arrangement has been disclosed meeting the objects and advantageous features set out hereinbefore as well as others. Numerous modifications will readily suggest themselves to those of ordinary skill in the art. For example, while motion of the cylinder release thumbpiece has been described for setting the safety to the applied or on condition, the motion of any other appropriate cylinder release mechanism such as the pulling of a cylinder pin could be used as could any other scheme for detecting a "cylinder open" condition. These as well as numerous other modifications as to the precise shapes, configurations and details may be made by those having ordinary skill in the art without departing from the spirit of the invention or the scope thereof as set out by the claims which follow.

What is claimed is:

1. A safety device for a handgun of the revolver type having a frame, a rotatable swing-out type cartridge receiving cylinder, an exposed pivotable cartridge striking hammer spring biased toward the cylinder and manually pivotable against the spring bias away from the cylinder preparatory to discharging a cartridge, and a thumbpiece movable between a first position facilitating insertion of cartridges into the cylinder and a second position where cartridges are captive within the cylinder, the safety device comprising; a hammer block which may be selectively positioned in a hammer engaging position to directly engage the hammer preventing pivotal movement of the hammer away from the cylinder, means responsive to movement of the thumbpiece from the second position to the first position thereof for releasing the cylinder to be swung out for reloading and for positioning the hammer block in the hammer engaging position and for retaining the hammer block in the hammer engaging position after loading of cartridges into the cylinder is completed and the cylinder is closed and locked, and until further deliberate movement independent of the cartridge loading process is effected to unblock the hammer and place the handgun in a ready to discharge condition, and detent means for automatically halting movement of the thumbpiece short of the second position when moving from the first position toward the second position while allowing unimpeded movement from the second position to the first position, the detent means comprising interengagable notched portions in the frame and in the thumbpiece and spring means engaging the frame and the thumbpiece for imparting a bias therebetween in a direction generally orthogonal to the direction of thumbpiece motion tending to interengage the notched portions.

2. The process of loading cartridges into a swing-out cylinder exposed hammer type revolver to insure that, upon completion of the loading process, the revolver is incapable of being fired without further action by a user independent of both the loading process and the firing process comprising positioning a hammer movement blocking member immediately adjacent the hammer each time the cylinder is opened and then closed to preclude cocking movement of the hammer, the hammer blocking member comprising a leaf spring which remains in position to preclude cocking after loading is completed and until manually moved by the user moving a toggle safety lever to cam the leaf spring against the natural bias thereof away from the hammer.

3. A safety device for a handgun of the revolver type having a frame, a rotatable swing-out type cartridge receiving cylinder, an exposed pivotable cartridge striking hammer spring biased toward the cylinder and manually pivotable against the spring bias away from the cylinder preparatory to discharging a cartridge, and a thumbpiece movable between a first position facilitating insertion of cartridges into the cylinder and a second position where cartridges are captive within the cylinder, the safety device comprising; a hammer block which may be selectively positioned in a hammer engaging position to directly engage the hammer preventing pivotal movement of the hammer away from the cylinder, and means responsive to movement of the thumbpiece from the second position to the first position thereof for releasing the cylinder to be swung out for reloading and positioning the hammer block in the hammer engaging position and for retaining the hammer block in the hammer engaging position after loading of cartridges into the cylinder is completed and the cylinder is closed and locked, and until further deliberate movement independent of the cartridge loading process is effected to unblock the hammer and place the handgun in a ready to discharge condition, the hammer block comprising a spring member biased toward the hammer engaging position, and a pivotable safety lever having a cam surface for engaging and moving the spring member against the bias thereof out of engagement with the hammer.

4. The safety device of claim 3 further comprising means coupling the thumbpiece to the safety lever for pivoting the safety lever in one rotational sense out of engagement with the spring member upon movement of the thumbpiece from said second position to said first position, one end of the safety lever being exposed with the deliberate independent movement being pivotal movement in an opposite rotational sense.

5. The process of loading cartridges into a swing-out cylinder exposed hammer type revolver of the type having a thumbpiece movable against spring bias from a normal closed and ready to fire position to a cylinder releasing position wherein the cylinder may be swung out for reloading to insure that, upon completion of the loading process, the revolver is incapable of being fired without further action by a user independent of both the loading process and the firing process comprising positioning a hammer movement blocking member immediately adjacent the hammer each time the cylinder is opened and then closed to preclude cocking movement of the hammer, automatically preventing complete return of the thumbpiece to the normally closed and ready to fire position each time the cylinder is closed after having been opened so that the hammer blocking member remains in position to preclude cocking after loading is completed and deliberately manually imparting an arcuate motion to the thumbpiece against the bias between the thumbpiece and the frame to release the thumbpiece to return to the normally closed and ready to fire position.

* * * * *